US006871481B2

(12) United States Patent
Scaliti et al.

(10) Patent No.: US 6,871,481 B2
(45) Date of Patent: Mar. 29, 2005

(54) APPARATUS AND PROCESS FOR PACKAGING AN ARTICLE WITH A FANTAIL WRAPPING

(75) Inventors: Pier Carlo Scaliti, Rodello (IT); Giovanni Sobrero, Cerreto Langhe (IT)

(73) Assignee: Soremartec S.A., Schoppach-Arlon (BE)

( * ) Notice: Subject to any disclaimer, the term of this patent is extended or adjusted under 35 U.S.C. 154(b) by 37 days.

(21) Appl. No.: 10/388,181

(22) Filed: Mar. 14, 2003

(65) Prior Publication Data

US 2004/0025469 A1 Feb. 12, 2004

(30) Foreign Application Priority Data

Mar. 15, 2002 (EP) ..... 02425156

(51) Int. Cl.[7] ..... B65B 11/08
(52) U.S. Cl. ..... 53/464; 53/221
(58) Field of Search ..... 53/464, 221, 222, 53/223, 226, 227

(56) References Cited

U.S. PATENT DOCUMENTS

| | | | | | |
|---|---|---|---|---|---|
| 2,265,636 | A | * | 12/1941 | Eaton | 53/222 |
| 2,513,459 | A | * | 7/1950 | Wesley | 53/226 |
| 2,830,417 | A | * | 4/1958 | Ullman et al. | 53/226 |
| 3,949,537 | A | * | 4/1976 | Jason et al. | 53/226 |
| 4,014,156 | A | * | 3/1977 | Klahn et al. | 53/227 |
| 4,733,521 | A | * | 3/1988 | Weder et al. | 53/221 |

FOREIGN PATENT DOCUMENTS

| | | | | |
|---|---|---|---|---|
| GB | 777 161 A | | 6/1957 | |
| GB | 1 064 031 A | | 4/1967 | |
| JP | 2-282014 | * | 2/1990 | 53/227 |

* cited by examiner

*Primary Examiner*—John Sipos
(74) *Attorney, Agent, or Firm*—Rothwell, Figg, Ernst & Manbeck

(57) ABSTRACT

An apparatus for packaging an article in a wrapping of a sheet material surrounding the article and closed in a fantail configuration, comprising:

shaping means suited to wrapping the article with the said wrapping of sheet material and shaping the wrapping into a general cup-like configuration formed into a plurality of loops surmounting the article, holding means suited to grasping the upper portions of the wrapping shaped in said manner in the connecting zones between said loops, to maintain said portions in an upright position, opposed pushing means which are intended to be operated subsequently to said holding means and which are displaceable between a retracted position and an advanced position, in which they interfere with the loops of the wrapping to impart a generally flattened configuration to the wrapping in the zone extending above the article, and opposed fastening means displaceable in a direction substantially at right angles to the direction of motion of said pushing means, and intended to be operated subsequently to said pushing means to fasten the wrapping, which is held in the flattened configuration by said pushing means, to form a pinched neck of the wrapping.

12 Claims, 9 Drawing Sheets

APPARATUS AND PROCESS FOR PACKAGING AN ARTICLE WITH A FANTAIL WRAPPING

The present invention relates to an apparatus and a process for packaging an article in a wrapping of a sheet or film material surrounding the article and closed in a fantail configuration.

A typical application of the apparatus and process according to the invention relates to the packaging of confectionery products, such as for example chocolate eggs, where the fantail wrapping not only protects the product but also performs an aesthetic function to attract the consumer.

Such packages are produced by positioning the confectionery product in supported manner in the central area of a wrapping sheet, which normally consists of a flexible film of paper material, a plastic or fabric laminate, and the peripheral portions of the wrapping sheet are lifted up to surround the product and fastened in an intermediate area, so forming a neck which is optionally closed by retaining means such that the free ends of the wrapping form a fantail or pennant.

Given the requirements of an aesthetic nature, it is desirable for the fantail to have a neat and reproducible configuration, but this is not readily achievable using ordinary packaging equipment and manual tidying-up operations are thus required.

The primary object of the present invention is to provide an apparatus and a process which allow the production of a fantail wrapping in which the fantail exhibits a neat configuration, so avoiding said manual tidying-up operations of its configuration.

This object, and others which will be clear from the following description, are achieved by means of an apparatus and a process as defined in the appended claims.

Other advantages and characteristics of the present invention will become clear from the following description which is given with reference to the appended drawings, which are provided by way of non-limiting example and in which.

Figure 1:
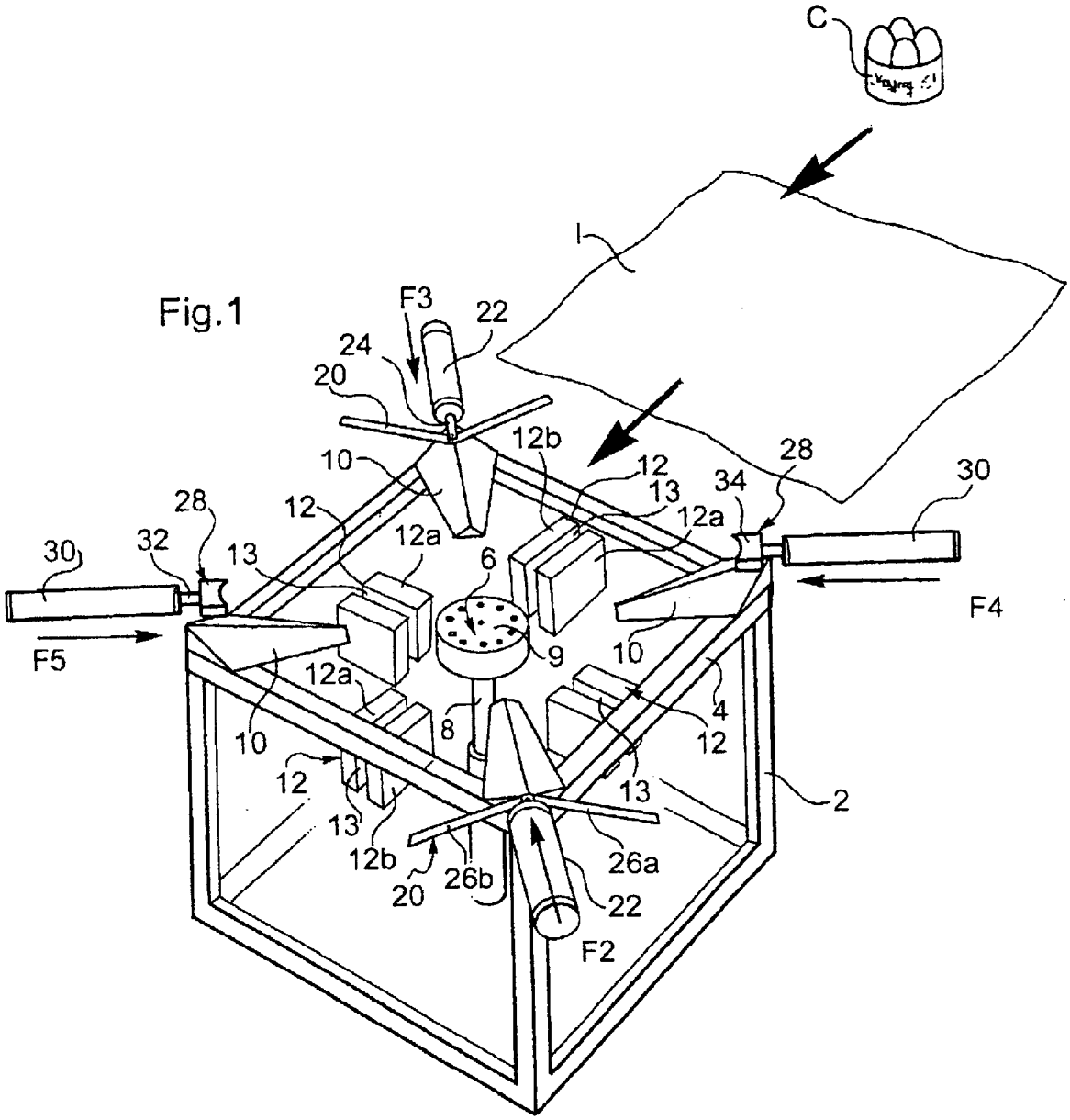
FIGS. 1–4 are diagrammatic perspective views showing part of the structure of the apparatus according to the invention depicted in four successive stages of operation.

The package obtainable according to the invention comprises a confectionery product, which, in the example shown, consists of a basket C including a plurality of small chocolate eggs. The confectionery product is enclosed within a wrapping I consisting of a film of sheet material, for example a film of plastics or paper laminate or optionally a piece of fabric which is generally of a decorative nature.

The wrapping encloses the confectionery product in the manner of a bag and is closed above the confectionery product with a retaining element, such as a ribbon N or another similar fastening element which is preferably of a decorative nature. Above the fastening zone, the wrapping extends to form a fantail F.

The sheet constituting the wrapping I is generally quadrangular in shape; however, it is understood that the process according to the invention is not restricted to this shape in that other shapes may conveniently be used for the wrapping sheet, for example sheets having a circular, jagged, zigzag or wavy perimeter in order to achieve different aesthetic effects in the general configuration of the fantail F.

Accordingly, no particular restrictions apply with regard to the configuration of the perimeter of the wrapping sheet used for the purposes of the process and with the apparatus of the invention.

Said apparatus comprises a supporting structure 2, including a frame 4 designed so as to support the perimetric edges of the wrapping sheet I.

In the central zone of the frame 4 there is arranged a supporting member 6 with an upper face 9 suited to holding the product to be packaged in supported manner. The supporting member 9 is operated by an actuator 8, for example of the hydraulic or electric type, and is vertically displaceable between a lowered position and a raised position.

Preferably, the upper face 9 of the supporting member 6 has a plurality of through-holes which communicate with a chamber which, in turn, communicates with vacuum generation means.

There are associated with the supporting structure 2 static shaping means 10, 12 suited to wrapping the product to be packaged C with the wrapping I and shaping the wrapping I into a general cup-like shape within which the product to be packaged is positioned.

In the embodiment illustrated in the drawings, the apparatus comprises first male shaping means 10 and second female shaping means 12.

Figure 4:
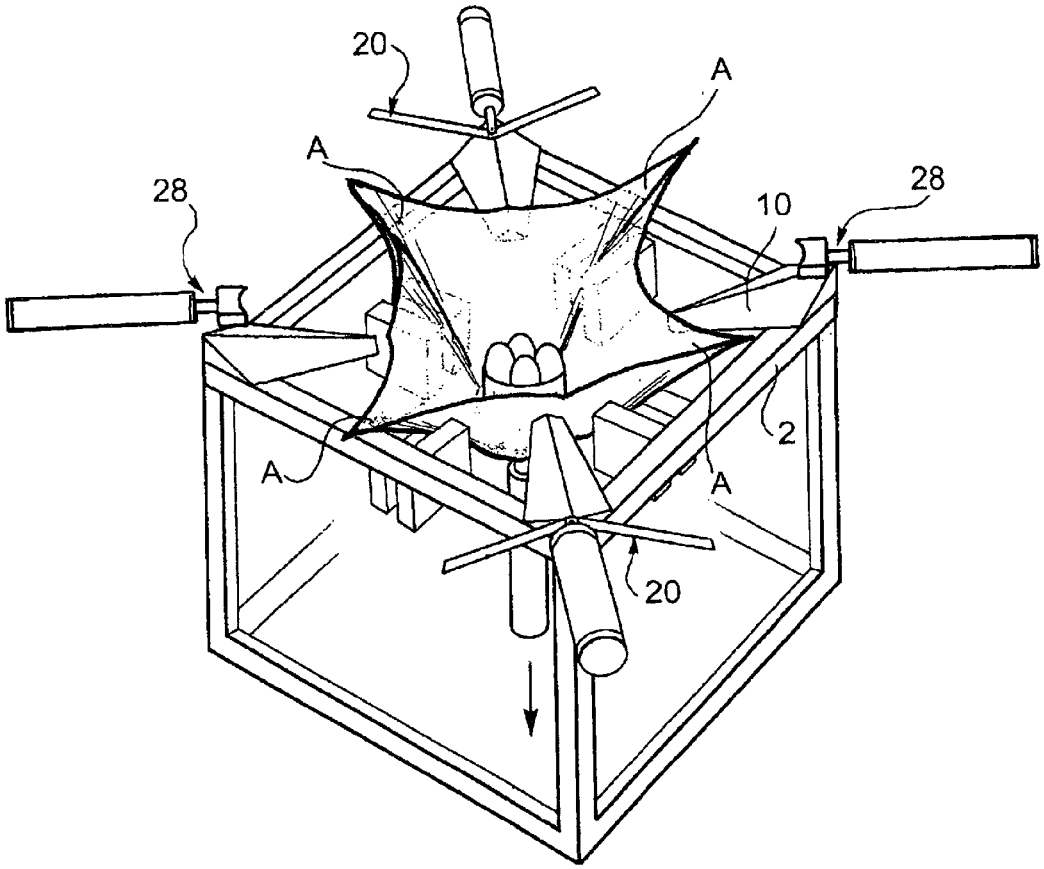

The male shaping means comprise a plurality of elements 10 protruding towards the interior of the supporting structure 2, angularly spaced by approx. 90° and arranged in opposed pairs across the diagonals of the supporting frame. Such shaping means 10 are mounted on the supporting structure 2 below the frame 4 and are suited to imparting an outwardly facing concave curvature to the wrapping sheet I. Such shaping means 10 cooperate with second female shaping means 12, each consisting of a pair of profiled elements 12*a*, 12*b* which define therebetween a slot 13 suited to forming the wrapping into a looped configuration A, once the wrapping sheet I has been inserted into said slots (FIG. 4).

In the example shown, there are four female shaping means 12, so as to produce four loops A1, A2, A3 and A4, and said means are arranged in opposed twos mutually angularly spaced by approx. 90°, each being arranged at an angular spacing of approx. 45° relative to the adjacent male shaping means 10.

The shaping means 12 extend vertically with the inlet opening of the slot 13 arranged at a lower level relative to the shaping means 10.

The apparatus also comprises holding means 14 (FIGS. 5–7) which are vertically displaceable in accordance with the direction of the arrow F1 above the supporting member 6 between a raised position and a lowered position, operated by a linear actuator 16. The holding means 14 comprise a plurality of holding members 18, in the example shown four holding members arranged in a cross, which are simultaneously displaceable between an open position and a closed position, in which the members can grasp the upper portions of the wrapping in the connecting zones R between the adjacent loops A.

The supporting structure 6 is associated with a pair of opposed pushing means 20, which are displaceable in a horizontal plane in accordance with the directions of the arrows F2 and F3, each operated by its own actuating member 22.

Said pushing means 20 are mounted above the supporting frame 4 and, in the preferred and illustrated configuration, are aligned in the direction of extension of a pair of male shaping means 10.

Each pushing means 20 has a rod 24 driven by the respective actuator 22 and an arm 26 which may be at right angles to the rod or, preferably as shown, constituted by two portions 26*a*, 26*b* articulated to the rod and inclined relative to one another.

Under the action of the respective actuator 22, the pushing means 20 are displaceable between a retracted position and an advanced position towards the central zone of the supporting frame 4, in which the respective arms 26 interfere with the loops A of the wrapping I to impart a generally flattened configuration to the wrapping I.

Preferably, in the retracted configuration, the arms 26*a*, 26*b* are arranged in a configuration inclined one to another, forming an outwardly open angle and, when the pushing member 20 is advanced until it comes into contact with the loops A of the wrapping I, the said arms 26*a*, 26*b* are brought into alignment.

Fastening means, denoted 28, are driven by a respective actuator 30 and are displaceable in a substantially horizontal plane between a retracted position and an advanced position in accordance with the direction of the arrows F4 and F5, substantially at right angles to the direction of movement of the pushing means 20.

Each fastening means 28 has a rod 32, operated by a respective actuator 30, and a fastening member 34 suited to fastening the cup-like wrapping, held in the flattened configuration by the pushing means 20, so forming a neck located in the wrapping I above the packaged article.

The fastening means 28 are generally displaceable in a horizontal plane beneath the horizontal plane of motion of the pushing means 20.

To implement the process according to the invention, the stages of which are shown sequentially in the appended drawings, the wrapping sheet I is initially positioned with its perimetric edges resting on the supporting frame 4.

It is understood that said operation may be performed manually or mechanized sheet feeding means suitable for this purpose may be provided.

Figure 2:
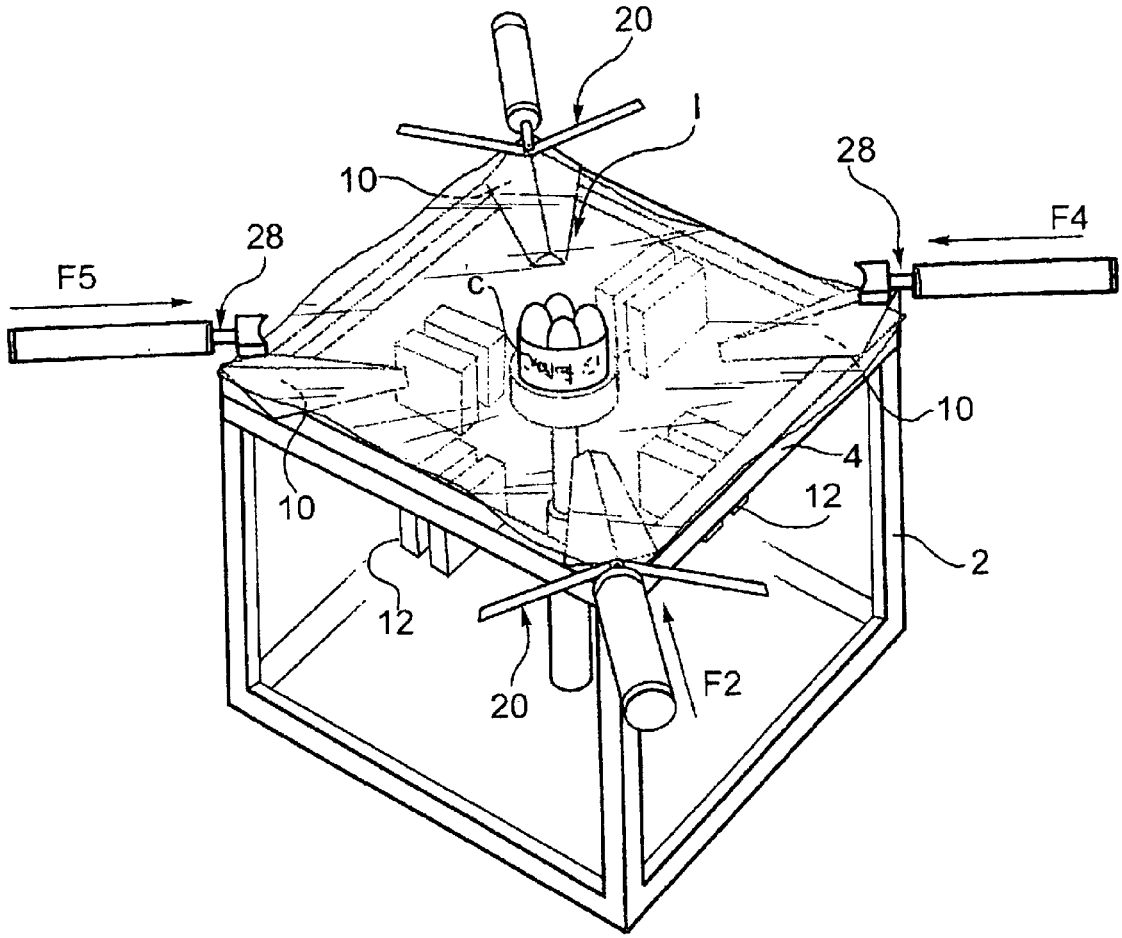

The product to be packaged C is then positioned in supported manner on the supporting member 6 on top of the wrapping sheet I (FIG. 2).

The vacuum generation device (not shown) is then operated through the perforated face 9 of the supporting member, so causing the wrapping sheet I to adhere to said face 9 and, simultaneously, the actuator 8 is operated to cause the supporting member 6 to descend from its raised position to its lowered position.

Figure 3:
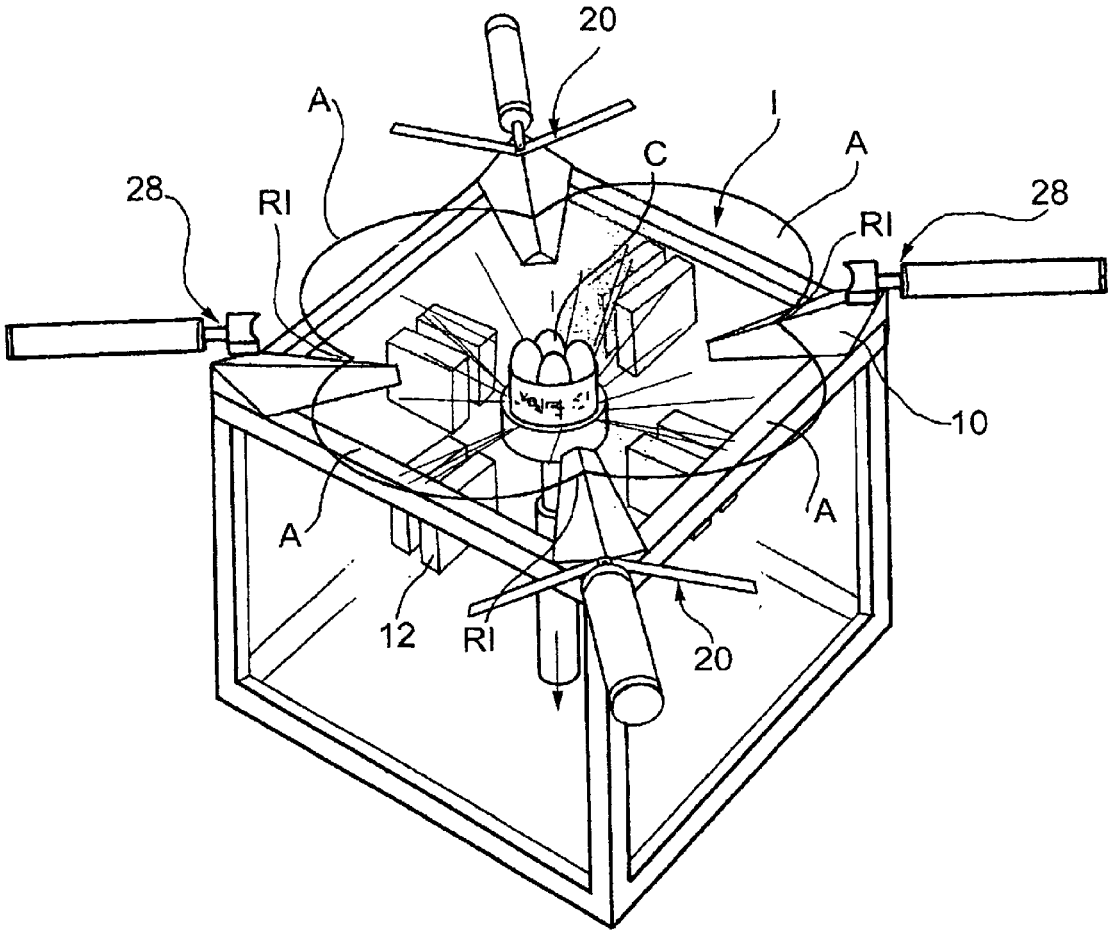

In the initial phase of the descent of the supporting member 6, which draws with it the wrapping I, said wrapping interferes first with the static shaping means 10 which, in the interference zones indicated RI in FIG. 3, cause the wall of the sheet to bend with an outwardly facing concave curve and initially shape the sheet into a relatively open cup-like configuration with four main loops A (FIG. 3).

Figure 5:
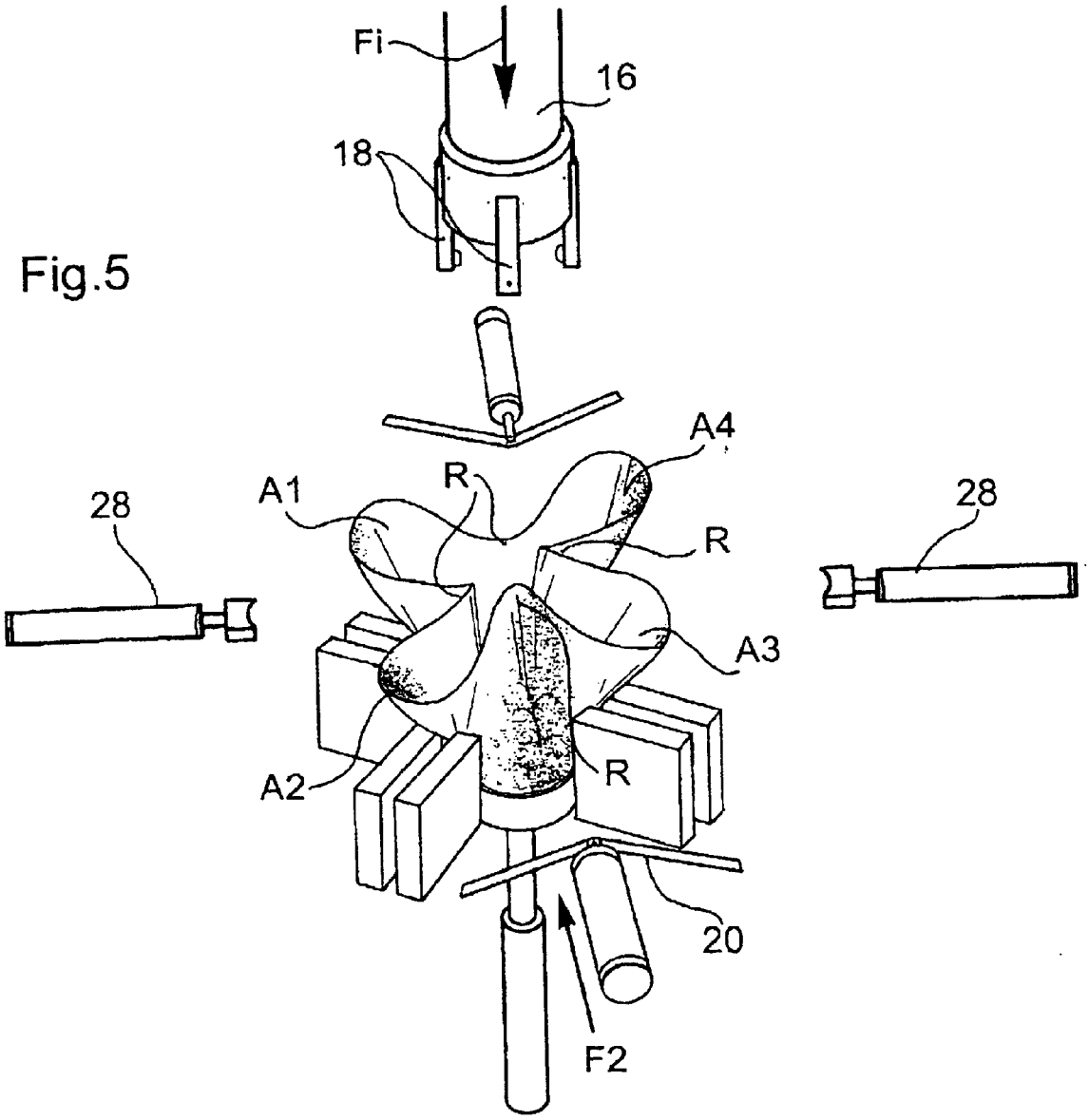
FIGS. 5–8 are likewise perspective views which show in sequence further operating phases of the process carried out by the apparatus subsequent to the operating phases shown by FIGS. 1–4.

As the descent of the wrapping continues, the loops A interfere with the female static shaping means 12 in such a manner that the walls of the wrapping I defining the loops A enter within the slots 13, so causing the formation of relatively closed loops A (FIG. 4) in the zone of the wrapping above the product C inserted therein. The upper, open mouth of the wrapping shaped in this manner thus assumes a configuration which, viewed from above, has four loops A1, A2, A3, A4 in a cross or clover-leaf arrangement (FIG. 5).

In the following stage, the holding means 14 are lowered, with the holding members 18 initially being kept in the open position in order to line up said holding members 18 with the upper portion of the wrapping I in the connecting zones R between adjacent loops A.

At this point, the holding members 18 are brought into their closed position to grasp the portions of the wrapping in said connecting zones.

Figure 6:
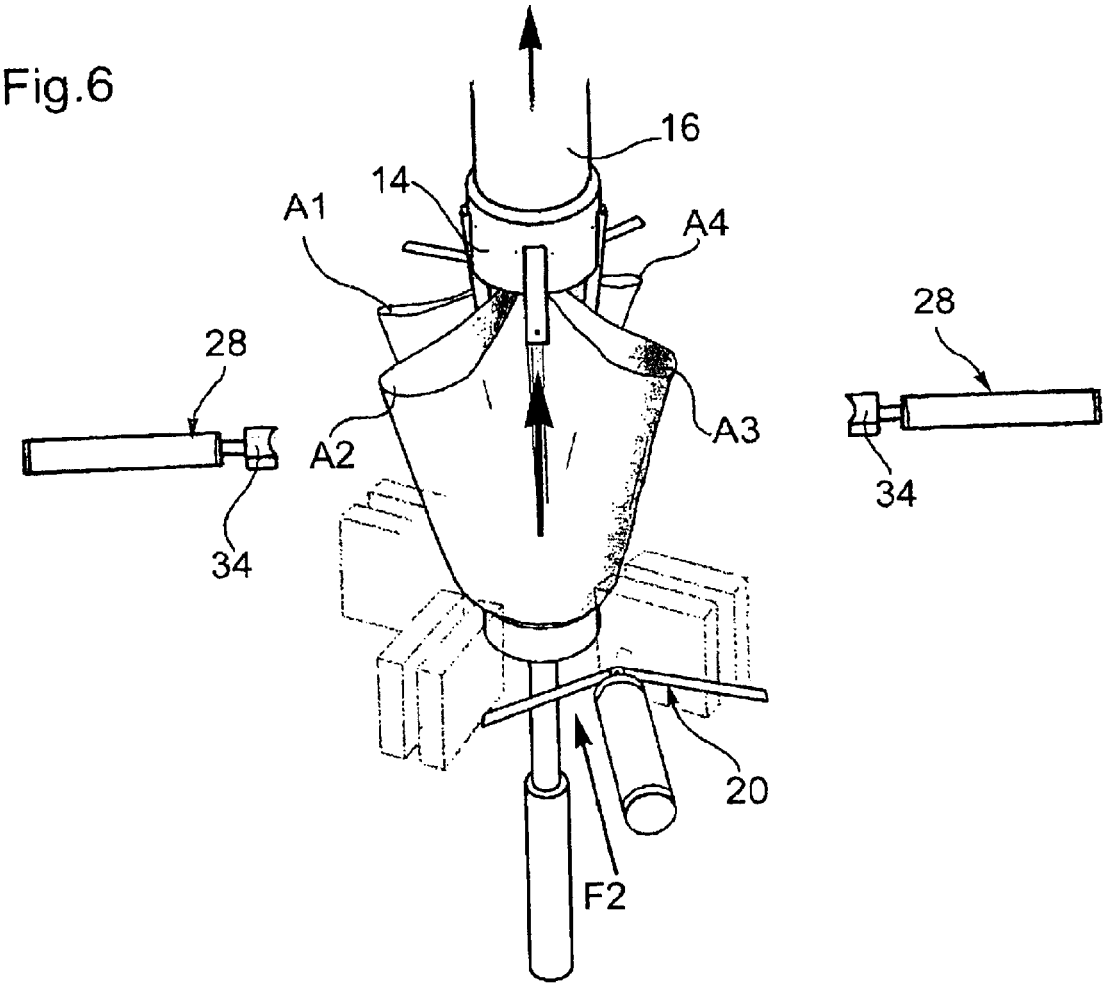

In the subsequent stage, the holding means 14 are raised vertically to lift up the wrapping shaped in this manner and to extract it from the shaping means. The wrapping, in a cup-like shape closed in the centre by the holding means and including the product C, is brought into a raised position suspended above the frame 4 (FIG. 6). The underside of the wrapping I may optionally be supported at this stage by the supporting member 6 which has been returned to a raised position.

Figure 7:
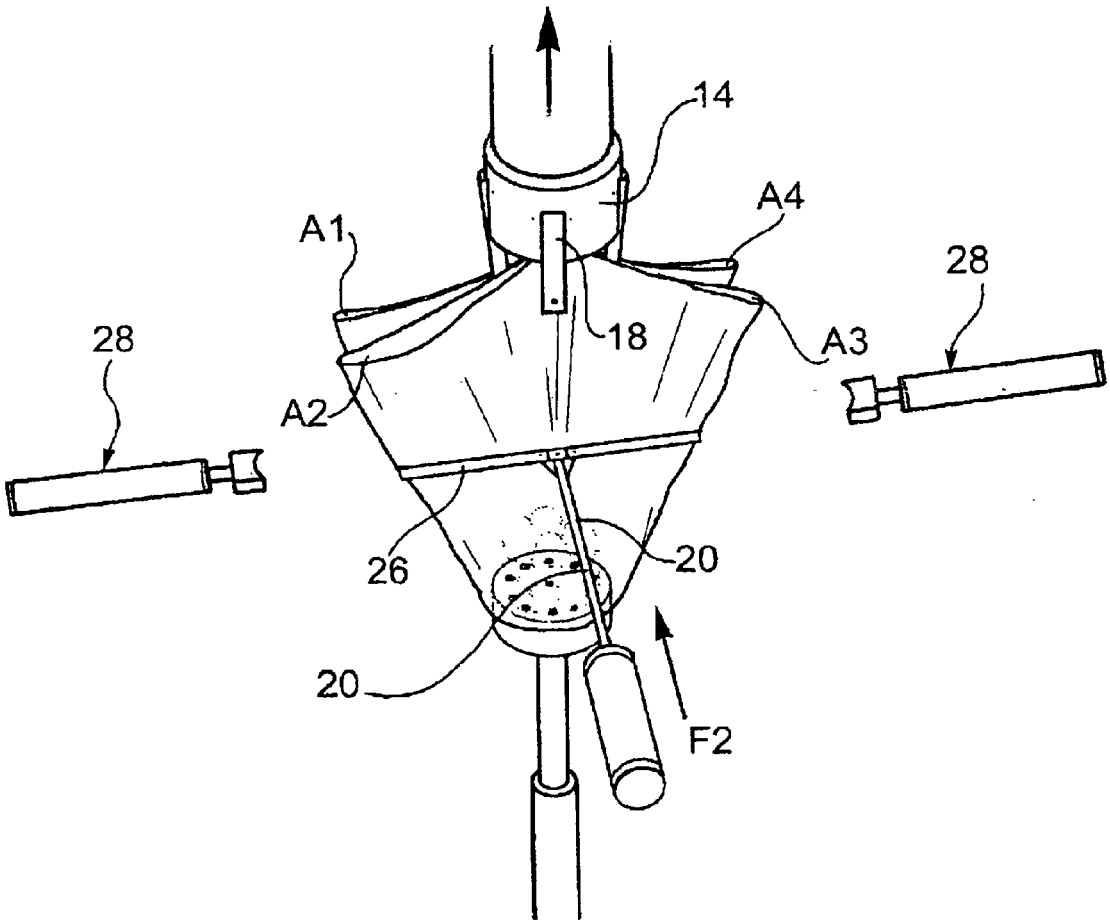
Figure 8:
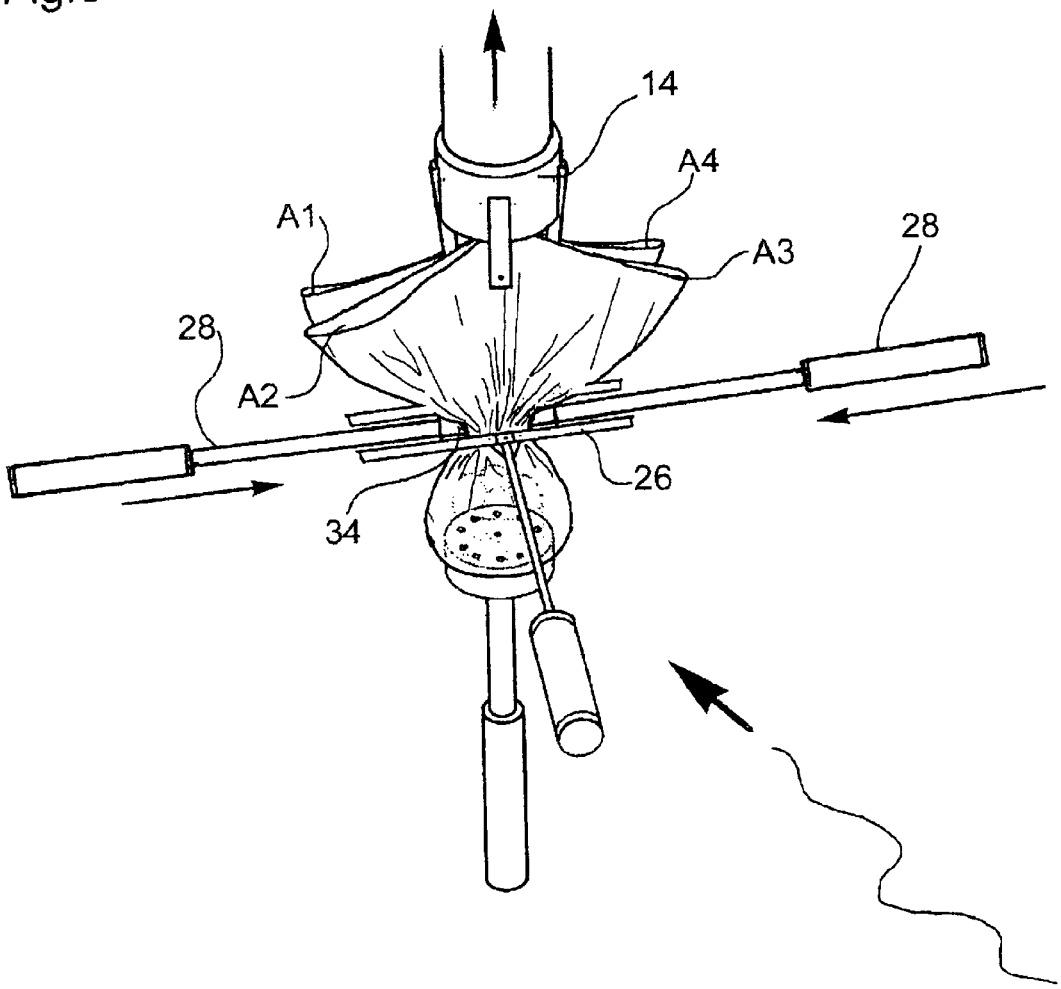

The pushing means 20 are then brought from their retracted position to their advanced position, such that the arms 26 interfere with opposed pairs of adjacent loops A2, A3 and A1, A4, respectively, causing them to splay apart and shaping the wrapping I into a generally flattened configuration (FIG. 7).

While the wrapping I is held in said flattened configuration by the pushing means 20, the fastening means 28 are brought from their retracted position to their advanced position to pinch shut the wrapping I, so obtaining the desired fantail configuration.

The fastening members 34 of the fastening means 30 each have a hollow front face capable of encompassing two adjoining loops A3, A4 and A1, A2, respectively, in the zone of the wrapping below the arms 26, so forming a closing neck of the wrapping I.

Closure of the wrapping I is then made permanent by means of manual application of a closing element, such as ribbon, string or adhesive tape.

Although the apparatus according to the invention has been described herein with reference to a specific embodiment of the shaping means, it is understood that the scope of protection of the invention comprises the use of other shaping means suited to shaping the wrapping into a cup-like configuration and with loops of the type described above.

Thus, for example, the desired configuration of the wrapping may be achieved, instead of with shaping means which cooperate with a descending movement of the wrapping and the product contained therein, with shaping means suited to lifting the wrapping sheet into a cup-like configuration surrounding the product to be packaged.

By way of example, such shaping means may comprise a plurality of articulated arms, for example four arms, arranged in a substantially horizontal plane in a cross configuration (in the case of a quadrangular wrapping, in accordance with the diagonals of the sheet) below the wrapping on which the product to be packaged is placed in supported manner, where said articulated arms are capable of being raised such that the wrapping encloses the product in a cup-like configuration; in said embodiment, said articulated arms may conveniently have a perforated upper face in contact with the wrapping sheet and have a hollow structure connectable with vacuum generation means for the purpose of achieving adhesion by suction of the wrapping sheet onto such arms.

The scope of the invention accordingly envisages other shaping means suited to performing the same function described above, such as, by way of further example, the use of a shaping hopper with forming elements arranged so as to achieve the desired cup-like configuration with loops.

Moreover, although the present description has described a specific cup-like configuration formed from four main adjacent loops, it is understood that the process and apparatus according to the invention are not restricted to creating said configuration. It is furthermore possible to consider a more complex cup-like configuration formed from a plurality of pairs of loops, for example six loops.

Figure 9:
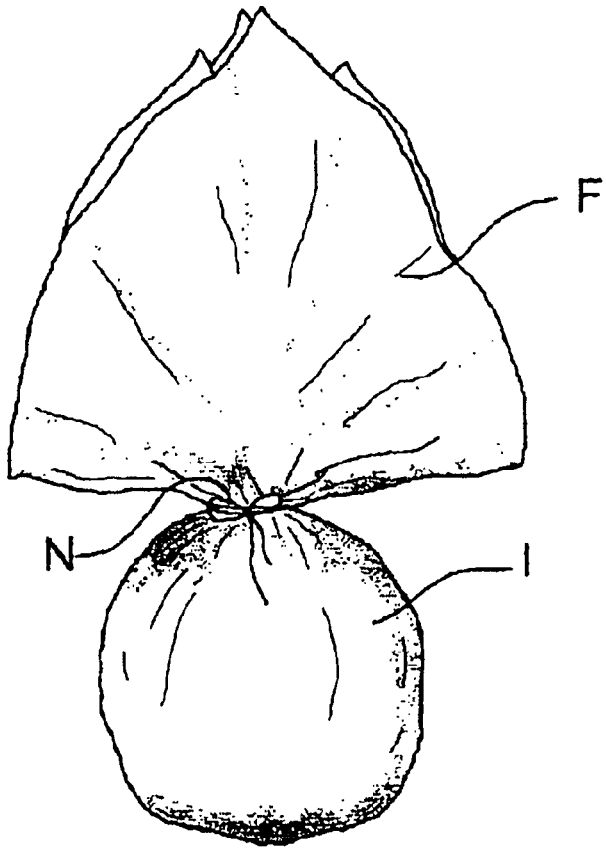
FIG. 9 is a perspective view of a package obtainable according to the invention.
Figure 10:
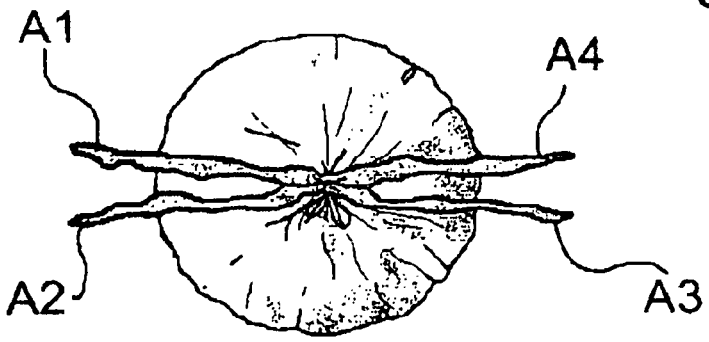
FIG. 10 is a plan view of the package of FIG. 9.

The apparatus and process according to the invention allow the production of a fantail package of the type shown in FIGS. 9 and 10 having a fantail shape which is consistently reproducible and without defects, such as creases, wrinkles or other unwanted malformations which would require other manual tidying-up operations of the fantail.

Naturally, the principle of the invention remaining the same, the forms of embodiment and details of construction may be varied widely with respect to those described and illustrated without thereby departing from the scope of the invention as defined in the following claims.

What is claimed is:

1. An apparatus for packaging an article in a wrapping of a sheet material surrounding the article and closed in a fantail configuration, comprising:

shaping means for wrapping the article with the said wrapping of sheet material and shaping the wrapping into a general cup-like configuration which upper portions formed into a plurality of loops surmounting the article, holding means for grasping the upper portions of the wrapping shaped in said manner in the connecting zones between said loops, to maintain said portions in an upright position, opposed pushing means which are intended to be operated subsequently to said holding means and which are displaceable between a retracted position and an advanced position, in which they interfere with the loops of the wrapping for imparting a generally flattened configuration to the wrapping in the zone extending above the article, and opposed fastening means displaceable in a direction substantially at right angles to the direction of motion of said pushing means, and intended to be operated subsequently to said pushing means for fastening the wrapping, which is held in the flattened configuration by said pushing means, to form a pinched neck of the wrapping.

2. An apparatus according to claim 1, comprising:

a supporting structure with a frame for supporting the perimetric edges of the wrapping of sheet material, a supporting member provided in the central zone of the supporting structure, which member is displaceable between a raised position, in which it supports the wrapping sheet positioned on said frame and the article to be packaged on top of the sheet, and a lowered position, in which the wrapping sheet associated with the supporting member is formed by said shaping means into the cup-like structure.

3. An apparatus according to claim 2, comprising vacuum generating means associated with said supporting member, said vacuum generating means being operable to cause the wrapping sheet to adhere to the supporting member.

4. An apparatus according to claim 1, wherein said shaping means comprise a plurality of male shaping means comprising elements protruding towards the interior of the supporting structure below the frame, said male shaping means being capable of cooperating with the wrapping sheet to impart to the wall of the sheet an outwardly facing concave curve, and second female shaping means each defining a slot suited to shaping the wall of the wrapping inserted into said slots into a configuration with loops.

5. An apparatus according to claim 4, wherein said male shaping means comprise four formations protruding towards the interior of the supporting structure angularly spaced by approximately 90° and arranged in opposed twos.

6. An apparatus according to claim 4, wherein each of said female shaping means comprises profiled elements defining therebetween a slot and arranged in opposed twos, angularly spaced by approximately 90°, each being arranged at an angular spacing of approximately 45° relative to the adjacent male shaping means.

7. An apparatus according to claim 2, wherein said pushing means comprise opposed arm members which are displaceable in a substantially horizontal plane between a retracted position and an advanced position and are arranged in aligned manner above the supporting frame, where said arms are capable, once advanced into the advanced position, of splaying apart adjacent loops of opposed pairs of loops of the wrapping.

8. An apparatus according to claim 1, wherein said holding means are vertically displaceable between a raised position and a lowered position and comprise a plurality of holding members displaceable between an open position and a closed position and in which, in the closed position, said holding members are capable of grasping the portions of the wrapping in the connecting zones between said loops.

9. An apparatus according to claim 1, wherein said fastening means are displaceable in a substantially horizontal plane between a retracted position and an advanced position and each comprises complementary holding formations which, in the advanced position, are capable of pinching shut the wrapping, forming a closing neck.

10. A process for packaging an article with a wrapping of sheet material surrounding the article and closed in a fantail arrangement, comprising the steps of:

wrapping the article with said wrapping of sheet material, shaping the wrapping into a general cup-like configuration, which upper portions formed into a plurality of loops, surrounding and surmounting the article, grasping the upper portions of the wrapping shaped in said manner in the connecting zone between said loops to maintain the portions in an upright position, splaying adjacent loops of opposed pairs of loops of the wrapping to impart to the wrapping a generally flattened configuration in the zone protruding above the article and fastening the neck of the wrapping, held in said flattened configuration, by means of a direct fastening action in a direction generally at right angles to the general plane of said flattened configuration.

11. A process according to claim 10, wherein the wrapping and shaping operation of the wrapping is performed by shaping the wrapping into four adjacent loops.

12. A process according to claim 10, further comprising:

providing shaping means adapted to wrapping the article with the said wrapping of sheet material and shaping the wrapping into said general cup-like configuration formed into said plurality of loops surmounting the article, providing holding means adapted to grasping the upper portions of the wrapping shaped in said manner in the connecting zone between said loops, to maintain said portion in said upright position, providing opposed pushing means which are intended to be operated subsequently to said holding means and which are displaceable between a retracted position and an advanced position, in which they interfere with the loops of the wrapping to impart said generally flattened configuration to the wrapping in the zone protruding above the article, and providing opposed fastening means displaceable in a direction substantially at right angles to the direction of motion of said pushing means, and intended to be operated subsequently to said pushing means to fasten the neck of wrapping, which is held in the flattened configuration by said pushing means, to form a pinched neck of the wrapping.

* * * * *